United States Patent [19]

Fujimura et al.

[11] Patent Number: 4,773,378

[45] Date of Patent: Sep. 27, 1988

[54] FUEL SUPPLY CONTROL METHOD FOR INTERNAL COMBUSTION ENGINES AFTER STARTING IN HOT STATE

[75] Inventors: Akira Fujimura; Yoshio Wazaki, both of Wako, Japan

[73] Assignee: Honda Giken Kogyo K.K., Tokyo, Japan

[21] Appl. No.: 119,705

[22] Filed: Nov. 12, 1987

[30] Foreign Application Priority Data

Dec. 27, 1986 [JP] Japan ..... 61-310657

[51] Int. Cl.[4] ..... F02B 3/00

[52] U.S. Cl. ..... 23/491; 123/179 L

[58] Field of Search ..... 123/491, 179 L

[56] References Cited

U.S. PATENT DOCUMENTS

| | | | |
|---|---|---|---|
| 4,469,072 | 9/1984 | Kobayashi | 123/179 L |
| 4,478,194 | 10/1984 | Yamato | 123/491 |
| 4,492,206 | 1/1985 | Hasegawa | 123/491 |
| 4,582,036 | 4/1986 | Kiuchi | 123/491 |

*Primary Examiner*—Ronald B. Cox
*Attorney, Agent, or Firm*—Arthur L. Lessler

[57] ABSTRACT

A method of controlling the supply of fuel to an internal combustion engine after starting, wherein an initial value of a fuel increment is set to a value dependent upon a temperature of the engine after starting thereof, the fuel increment is progessively decreased from the set initial value thereof at a predetermined rate, and a fuel quantity corrected by the decreased fuel increment is supplied to the engine. A temperature of the intake system of the engine is sensed. The above predetermined rate of decrease of the fuel increment is set to a larger value as the sensed temperature of the intake system is higher. Preferably, when the sensed temperature of the intake system is higher than a predetermined value corresponding to the boiling point of fuel, the predetermined rate of decrease of the fuel increment is set to a larger value than that to which it is set when the sensed temperature is lower than the predetermined value.

8 Claims, 6 Drawing Sheets

FUEL INJECTION VALVES
6
INTERNAL COMBUSTION ENGINE
1
THREE-WAY CATALYST
14
13
12
Ne
11
Tw
10
TA
9
PBA
8
7
2
3
3'
4
θTH
16
17
STARTER SWITCH
5a
5b
5c
5d
5
INPUT CIRCUIT MEANS
CPU
MEMORY MEANS
OUTPUT CIRCUIT MEANS
ECU

FUEL SUPPLY CONTROL METHOD FOR INTERNAL COMBUSTION ENGINES AFTER STARTING IN HOT STATE

BACKGROUND OF THE INVENTION

This invention relates to a fuel supply control method for internal combustion engines after starting, and more particularly to a method of this kind which is adapted to control a fuel increment for a fuel quantity supplied to an internal combustion engine immediately after being started, to a proper value dependent upon the temperature of an intake system of the engine.

Conventionally, a fuel supply control method for internal combustion engines after starting has been proposed e.g. by Japanese Provisional Patent Publication (Kokai) No. 62-93443 owned by the assignee of the present application, wherein the initial value of a fuel increment is set to a value dependent upon the temperature of the engine immediately after starting thereof, then the fuel increment is progressively decreased from the initial value thereof thus set at a predetermined rate, and a fuel quantity corrected by the fuel increment thus decreased is supplied to the engine, to thereby prevent engine stalling after starting of the engine and achieve smooth transition of the engine operation to an accelerating condition immediately after starting of the engine.

However, the above proposed method has the disadvantage that fuel supply cannot be properly effected immediately after starting of the engine when the engine coolant temperature is high at the start of the engine. More specifically, if the engine coolant temperature is already high at the start of the engine, the period of time after the start of the engine and until the engine coolant temperature increases to such a high level that it is no longer necessary to effect the after-start fuel increasing is very short. Accordingly, after such hot starting of the engine the fuel quantity need not be increased by such an amount as required when the engine is started in a cold state, to overcome engine load during warming-up of the engine. Particularly, in the event that the engine is restarted soon after it has been stopped, the temperature of fuel within the intake system of the engine such as fuel injection valves is often so high that gas bubbles are formed in the fuel within the intake system, causing leaning of the mixture supplied to the engine. To prevent leaning of the mixture after hot starting of the engine, however, it suffices to remove gas bubbles from the fuel within the intake system but it is not necessary to increase the fuel quantity. However, according to the aforesaid proposed method, the fuel increasing period after the start of the engine is not set to a value dependent upon the temperature of the engine upon starting in a hot state, that is, even after the start of the engine in a hot state the after-start fuel increasing is effected over a long period of time which is appropriate to engine starting in a cold or normal temperature state, which results in overriching of the mixture supplied to the engine and increased fuel consumption.

SUMMARY OF THE INVENTION

It is the object of the invention to provide a fuel supply control method for internal combustion engines after starting, which is capable of preventing overriching of the mixture supplied to the engine after starting in a hot state to thereby ensure good driveability after starting of the engine, and curtailing the fuel consumption.

The present invention provides a method of controlling the supply of fuel to an internal combustion engine having an intake system after starting, wherein an initial value of a fuel increment is set to a value dependent upon a temperature of the engine after starting thereof, the fuel increment is progressively decreased from the set initial value thereof at a predetermined rate, and a fuel quantity corrected by the progressively decreased fuel increment is supplied to the engine.

The method according to the invention is characterized by comprising the steps of:

(a) sensing a temperature of the intake system of the engine; and (b) setting the above predetermined rate at which the fuel increment is progressively decreased to a larger value as the sensed temperature of the intake system is higher.

Preferably, the temperature of the intake system is sensed immediately after the starting of the engine.

Preferably, when the sensed temperature of the intake system is higher than a predetermined value corresponding to the boiling point of fuel, the predetermined rate of decrease of the fuel increment is set to a larger value than that to which it is set when the sensed temperature is lower than the predetermined value.

More pereferably, the initial value of the fuel increment is set at the time of generation of a pulse of a predetermined control signal, pulses of which are representative of respective predetermined crank angles of the engine, immediately after completion of cranking of the engine, the set initial value of the fuel increment being subsequently decreased by a predetermined amount each time a first predetermined number of pulses of the control signal are generated when the sensed temperature of the intake system is lower than the predetermined value corresponding to the boiling point of fuel, and the set initial value of the fuel increment being subsequently decreased by the predetermined amount each time a second predetermined number of pulses of the control signal are generated when the sensed temperature of the intake system is higher than the predetermined value, the second predetermined number being smaller than the first predetermined number.

Also preferably, the initial value of the fuel increment is set at the time of generation of a pulse of a predetermined control signal, pulses of which are representative of predetermined crank angles of the engine, immediately after completion of cranking of the engine, the set initial value of the fuel increment being subsequently decreased by a first predetermined amount each time a pulse of the control signal is generated when the sensed temperature of the intake system is lower than a predetermined value corresponding to the boiling point of fuel, and the set initial value of the fuel increment being subsequently decreased by a second predetermined amount each time a pulse of the control signal is generated when the sensed temperature of the intake system is higher than the predetermined value, the second predetermined amount being than the first predetermined amount.

The above and other objects, features, and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
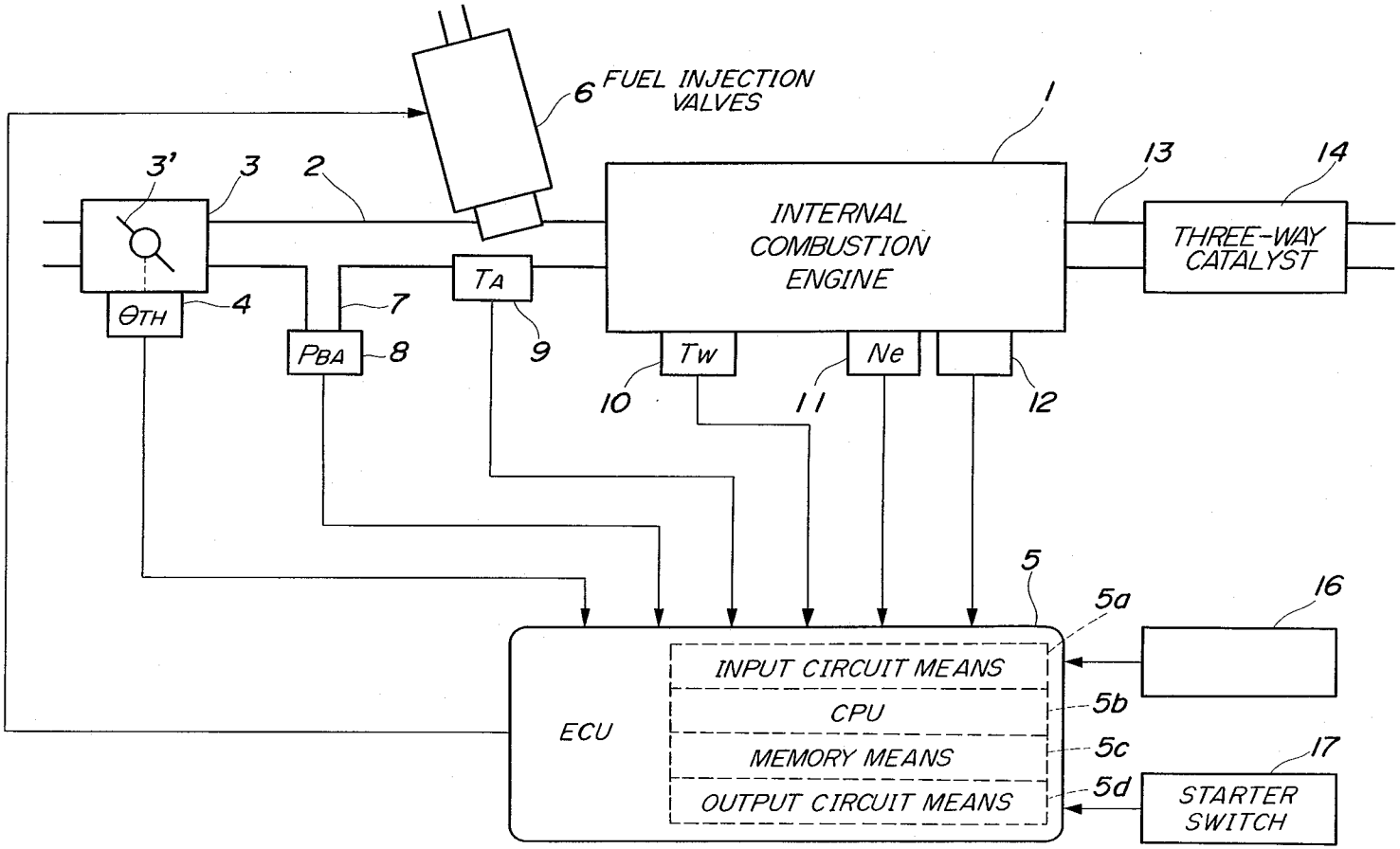
FIG. 1 is a block diagram showing the whole arrangement of a fuel supply control system for an internal combustion engine, to which is applied the method according to the invention.

Referring first to FIG. 1, there is shown the whole arrangement of a fuel supply control system for an internal combustion engine, to which is applied the method according to the invention. Connected to the engine 1 which may be a four-cylinder type is an intake pipe 2. Arranged at an intermediate portion of the intake pipe 2 is a throttle body 3 in which a throttle valve 3' is mounted. Connected to the throttle valve 3' is a throttle valve opening ($\theta$th) sensor 4 which converts the sensed throttle valve opening into an electric signal and delivering same to an electronic control unit (hereinafter called "the ECU") 5.

Fuel injection valves 6, only one of which is shown, are inserted into the interior of the intake pipe 2 at locations intermediate between the cylinder block of the engine 1 and the throttle body 3 and each arranged slightly upstream of an intake valve, not shown, of a corresponding one of the engine cylinders. The fuel injection valves 6 are connected to a fuel pump, not shown, and electrically connected to the ECU 5 to have their valve opening periods controlled by control signals therefrom.

An intake pipe absolute pressure ($P_{BA}$) sensor 8 is communicated via a pipe 7 with the interior of the intake pipe 2, for sensing absolute pressure within the intake pipe 2 and supplying an electric signal indicative of the sensed absolute pressure to the ECU 8 to which it is electrically connected.

An intake air temperature ($T_A$) sensor 9 is arranged in the intake pipe 2 at a location downstream of the intake pipe absolute pressure sensor 8, for converting the sensed intake air temperature ($T_A$) into an electric signal and sending same to the ECU 5.

The cylinder block of the engine 1 is provided therein with an engine coolant temperature ($T_W$) sensor 10 for sensing the temperature of engine coolant. The sensor 10 is formed of a thermistor, for instance, and is embedded in a peripheral wall of one of the engine cylinders filled with engine coolant, and electrically connected to the ECU 5 for supplying an electric signal indicative of the sensed coolant temperature thereto.

Arranged in facing relation to a camshaft or a crankshaft of the engine 1, neither of which is shown, are an engine rotational speed ($N_e$) sensor 11 for sensing the rotational speed of the engine and a cylinder-discriminating sensor 12 for sensing the position of a particular one of the engine cylinders, the sensors being electrically connected to the ECU 8 for supplying respective electric signals indicative of the sensed rotational speed and particular cylinder position thereto. The engine rotational speed sensor 11 is adapted to generate a pulse of a crank angle position signal (hereinafter called "the TDC signal") at each of predetermined crank angles in advance of a top dead center (TDC) corresponding to the start of a suction stroke of each of the cylinders each time the engine crankshaft rotates through 180 degrees in the case of a four cycle-four cylinder engine, and the cylinder-discriminating sensor 12 is adapted to generate a pulse of a cylinder-discriminating signal at a predetermined crank angle position of the particular engine cylinder, pulses of the TDC signal and the cylinder-discriminating signal being supplied to the ECU 5.

Arranged in an exhaust pipe 13 of the engine 1 is a three-way catalyst 14 for purifying HC, CO, and $NO_x$ ingredients contained in exhaust gases emitted from the engine 1.

Further connected to the ECU 5 are other sensors 16 for sensing other engine operating parameters such as the output voltage of a battery, not shown, provided for the engine, and a starting switch 17 of the engine 1, the position of which indicates the operation of a starting motor, not shown, of the engine 1, so that the ECU 5 is supplied with electric signals indicative of the sensed other engine operating parameters as well as the one-off state of the starting switch 17.

The ECU 5 comprises input circuit means 5*a* having functions, e.g. of shaping the waveforms of input signals from part of the aforementioned various sensors and the starting switch 17, shifting the levels of output voltages from part of the sensors into a predetermined level, and converting analog signals from part of the sensors into digital signals, a central processing unit (hereinafter called "the CPU") 5*b*, memory means 5*c* storing various control programs executed within the CPU 5*b* and for storing results of various computations also executed within the CPU 5*b*, and output circuit means 5*d* for supplying driving signals to the fuel injection valves 6.

Details of the control method according to the invention executed by the above described control system will now be explained.

Figure 2:
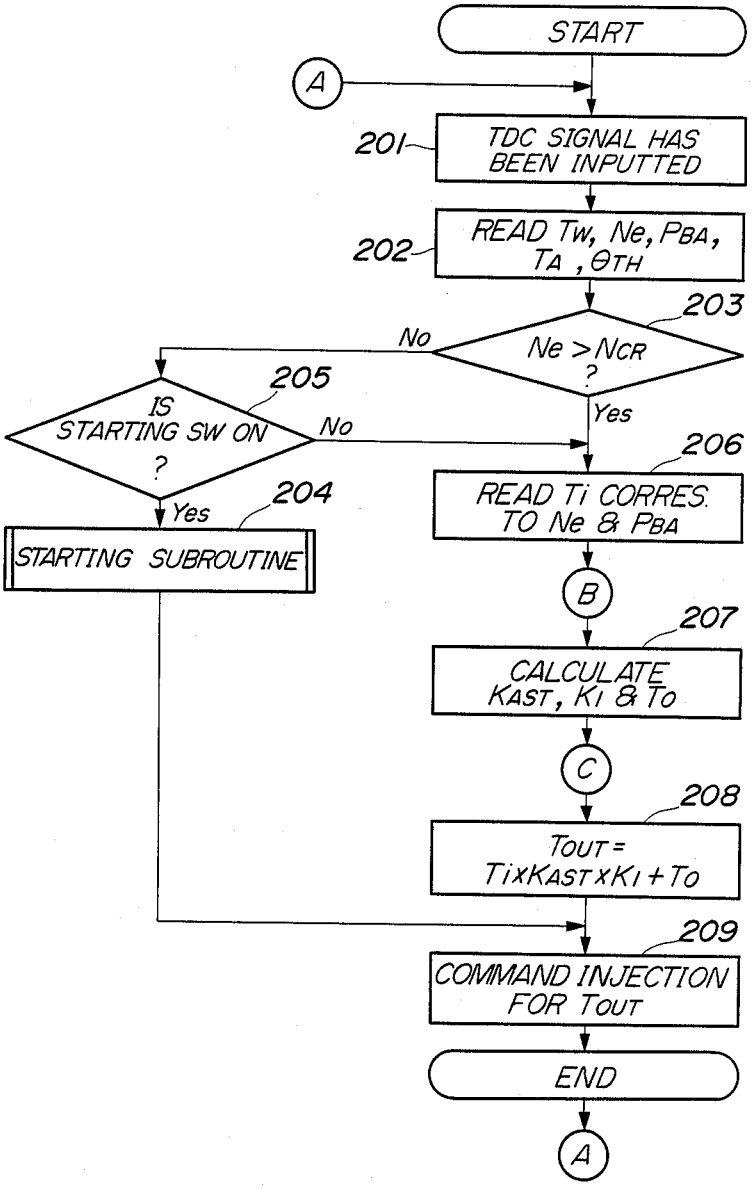
FIG. 2 is a flowchart of a program for calculating the valve opening period of fuel injection valves appearing in FIG. 1.

FIG. 2 shows a program for calculating the valve opening period of the fuel injection valves, which is executed in synchronism with each pulse of the TDC signal. When the starting switch 17 is turned on, the engine is started and TDC signal pulses are inputted to the ECU 5 (step 201). Each time a pulse of the TDC signal is inputted to the ECU 5, sensed values of the engine coolant temperature $T_W$, the intake pipe absolute pressure $P_{BA}$, the intake air temperature $T_A$, the throttle valve opening $\theta$th, the on-off state of the starting switch 17, etc., which are inputted to the ECU 5, are read by the CPU 5*b* at a step 202. Also at this step 202, a period of time elapsed from an immediately preceding pulse of the TDC signal to a present pulse thereof is counted, and a value of the engine rotational speed $N_e$ calculated from the counted time period is read by the CPU 5*b*. Then, it is determined at a step 203 whether or not the engine rotational speed $N_e$ has increased above a predetermined cranking value $N_{CR}$ (e.g. 400 rpm). If the answer to the question of the step 203 is negative or No, that is, if $N_e \leqq N_{CR}$ stands, the program proceeds to a step 205 to determine whether or not the starting switch 17 is on. If the answer is affirmative or Yes, that is, if the starting switch 17 is on, steps 204 and 209 are called to execute a starting subroutine wherein the valve opening period $T_{OUT}$ of the fuel injection valves 6 to be applied during starting operation of the engine 1 is calculated, and the fuel injection valves 6 are actuated to open over a period of time corresponding to the calculated $T_{OUT}$ value.

If the answer to the question of the step 203 is affirmative or YES, that is, if the engine rotational speed $N_e$ is higher than the predetermined cranking value $N_{CR}$, or if the answer to the question of the step 205 is negative or No, that is, if the starting switch 17 is off, it is judged that the engine has got rid of the cranking state, and then the program proceeds to steps 206–208 to calculate the valve opening period $T_{OUT}$ of the fuel injection valves 6 to be applied after the engine starting operation has been finished. First, at the step 206, a value of a basic fuel injection quantity or valve opening period $T_{OUT}$ is read from a $T_i$ map stored in the memory means 5*c* within the ECU 5, which corresponds to the sensed values of engine rotational speed $N_e$ and intake pipe absolute pressure $P_{BA}$.

Then, at the step 207 calculations are made of a correction coefficient $K_{AST}$, other correction coefficients $K_1$, and correction variables $T_o$. The correction coefficient $K_{AST}$ is an after-start fuel increasing coefficient (hereinafter merely called "fuel-increasing coefficient") as a fuel increment applied after the start of the engine, which is calculated by a $K_{AST}$ calculating subroutine, hereinafter described with reference to FIG. 3 or FIG. 7. $K_1$ are correction coefficients other than $K_{AST}$, and $T_o$ are correction variables as mentioned above, which are all set, based upon respective engine operating parameters, to appropriate values so as to optimize operating characteristics of the engine such as fuel consumption and emission characteristics.

At the step 208, the fuel injection period $T_{OUT}$ to be applied after the start of the engine is calculated in accordance with the following equation (1), by using the basic value $T_i$ read at the step 206 and the correction coefficients $K_{AST}$, and $K_1$ and correction variables $T_o$, followed by execution of the step 209 to actuate the fuel injection valve 6 on the basis of the calculated $T_{OUT}$ value:

$$T_{OUT} = T_i \times K_{AST} \times K_1 + T_o \quad (1)$$

Reference is now made to the subroutine for calculating the fuel increasing coefficient $K_{AST}$.

Figure 3:
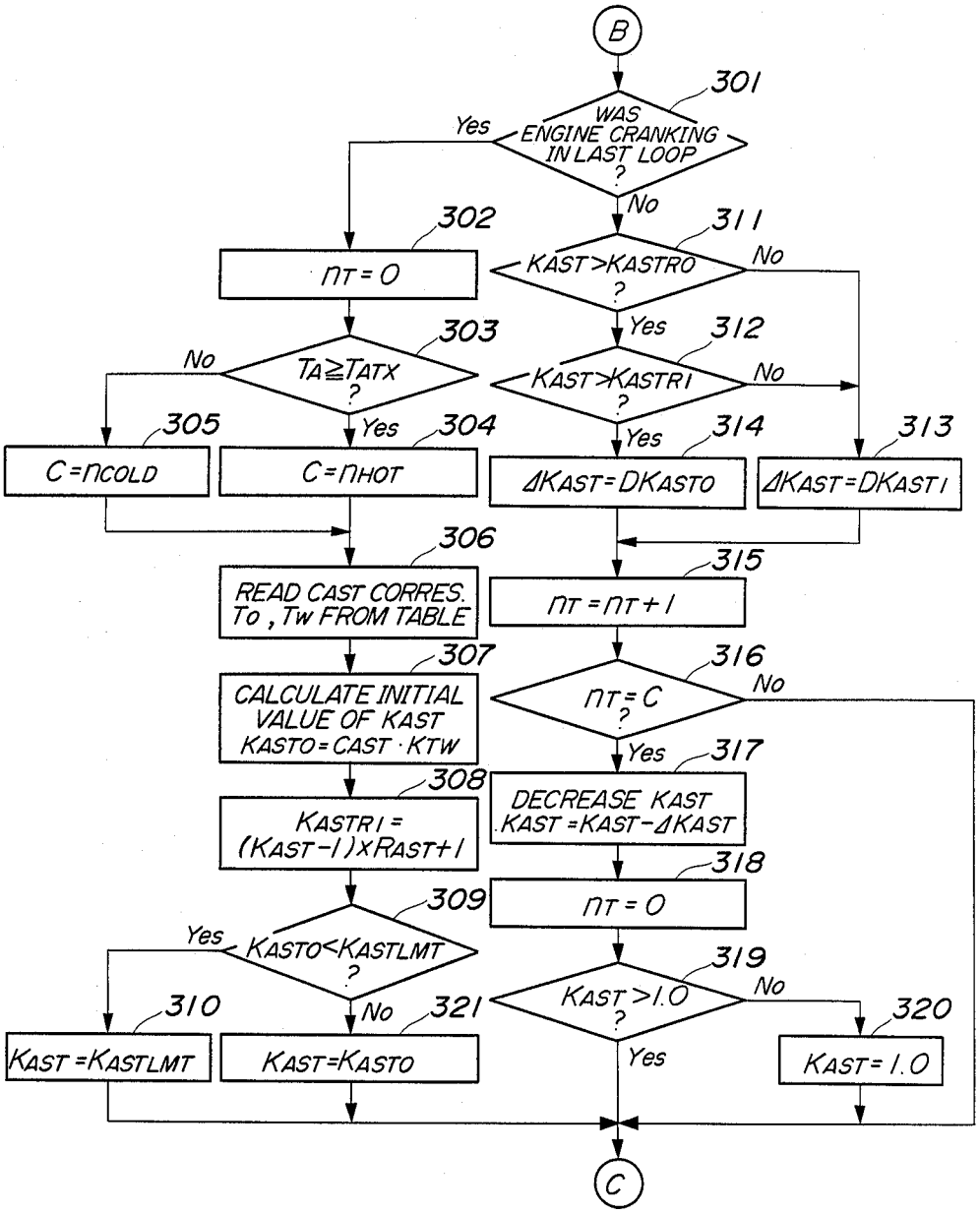
FIG. 3 is a flowchart of a subroutine for calculating an after-start fuel increasing coefficient $K_{AST}$ according to a first embodiment of the invention.

FIG. 3 shows the subroutine for calculating the fuel increasing coefficient $K_{AST}$, according to a first embodiment of the invention, which is executed at the step 207 in FIG. 2, each time a TDC signal pulse is generated. First, at a step 301 it is determined whether or not the engine was being cranked in the last loop. This determination is made in the same manner as in the steps 203 and 205 in FIG. 2. If the answer is affirmative or Yes, that is, if the present loop is the first one immediately after completion of the cranking operation of the engine 1, the program proceeds to a step 302 wherein a control variable nT is set to 0.

The control variable nT is used to determine whether the pulse of the TDC signal that triggers execution of the present loop of the subroutine is to trigger execution of decrease of the fuel increasing coefficient $K_{AST}$ to be described later, or suspension of same.

Then, the program proceeds to a step 303 to determine whether or not the sensed value of the intake air temperature $T_A$ is higher than a predetermined value $T_{ATX}$ (e.g. 70° C.). The sensed value of the intake air temperature $T_A$ was sensed, read and stored at the time of generation of the last pulse of the TDC signal that was applied during the starting operation of the engine, i.e. during cranking of the engine. The step 303 serves to determine whether or not there are formed gas bubbles in the fuel within the fuel injection valves 6 due to high temperature within the engine system. The intake air temperature $T_A$ is employed for this purpose because the intake air temperature sensor 9 is inserted into the interior of the intake pipe 2 at a location close to and upstream of one of the fuel injection valves 6 so that the intake air temperature $T_A$ sensed by the intake air temperature sensor 9 reflects the temperature within the fuel injection valves 6. Therefore, by comparing the sensed intake air temperature $T_A$ with the predetermined value $T_{ATX}$ which corresponds to the boiling point of fuel, it can be estimated whether or not gas bubbles are present in the fuel within the intake system of the engine such as the fuel injection valves 6 due to high engine temperature. The rate of decrease of the fuel increasing coefficient $K_{AST}$ is determined based upon the comparison result, as hereinafter described.

Then, a predetermined number C is set at a step 304 or a step 305. When the control variable nT reaches this predetermined number, that is, each time this predetermined number of TDC signal pulses are generated, the decrease of the fuel increasing coefficient $K_{AST}$ is effected. If the answer to the question of the step 303 is affirmative or Yes, that is, $T_A \geqq T_{ATX}$ stands, the step 304 is executed to set the predetermined number C to a value $n_{HOT}$ (e.g. 2) which indicates that gas bubbles are supposed to be present in the fuel, whereas if the answer to the question of the step 303 is negative or No, that is, $T_A < T_{ATX}$ stands, the step 305 is executed to set the predetermined number C to a value $n_{COLD}$ (e.g. 6) which indicates that no gas bubbles are present in the fuel.

Figure 4:
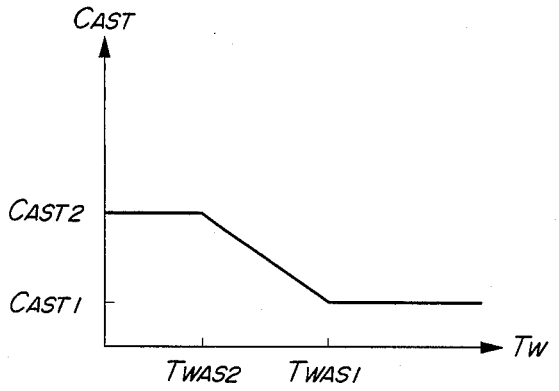
FIG. 4 is a graph showing a table of the relationship between a coolant temperature-dependent fuel increasing constant $C_{AST}$ applied for calculation of the value of the after-start fuel increasing coefficient $K_{AST}$ and the engine coolant temperature $T_W$.

Then the program proceeds to a step 306 wherein an engine coolant temperature-dependent coefficient $C_{AST}$ for calculating the initial value of the fuel increasing coefficient $K_{AST}$ is read from a $C_{AST}$ table stored in the memory means 5*c*, which corresponds to the sensed engine coolant temperature $T_W$. A value of the engine coolant temperature $T_W$ sensed at the time of generation of the last one of TDC signal pulses applied during the cranking operation of the engine is applied for reading-out of the $C_{AST}$ value. FIG. 4 shows an example of the $C_{AST}$ table. According to this table, when the engine coolant temperature $T_W$ is equal to or lower than a predetermined value $T_{WAS2}$ (e.g. −10° C.), a value $C_{AST2}$ (e.g. 1.2) is selected as the $C_{AST}$ value, and when the engine coolant temperature $T_W$ is higher than a predetermined value $T_{WAS1}$ (e.g. +10° C.), a value $C_{AST1}$ (e.g. 1.0) is selected. When the engine coolant temperature $T_W$ falls between $T_{WAS2}$ and $T_{WAS1}$, the $C_{AST}$ is determined by means of an interpolation method.

The $C_{AST}$ table may set in various forms depending upon the operating characteristics of engines applied.

The $C_{AST}$ value determined is substituted into the following equation (2) to calculate the initial value $K_{AST0}$ of the fuel increasing coefficient $K_{AST}$:

$$K_{AST0}=C_{AST}\times K_{TW} \quad (2)$$

where $K_{TW}$ is an engine coolant temperature-dependent fuel increasing coefficient read from a $K_{TW}$ table as a function of the engine coolant temperature $T_W$.

Figure 5:
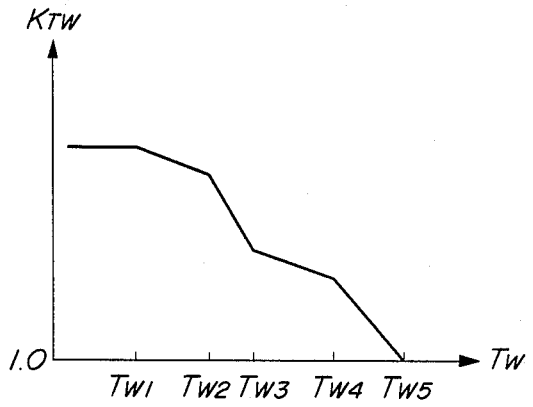
FIG. 5 is a graph showing a table of the relationship between a coolant temperature-dependent fuel increasing coefficient $K_{TW}$ and the engine coolant temperature $T_W$.

FIG. 5 is an example of the $K_{TW}$ table of the relationship between the engine coolant temperature $T_W$ and the engine coolant temperature-dependent fuel increasing coefficient $K_{TW}$. First, when the engine coolant temperature $T_W$ is higher than a predetermined value $T_{W5}$ (e.g. 60° C.), the $K_{TW}$ value is set to a value of 1.0. When the engine coolant temperature $T_W$ is equal to or lower than the predetermined value $T_{W5}$, the $K_{TW}$ value is set to one of five predetermined values corresponding, respectively, to five predetermined coolant temperature values $T_{W1}$–$T_{W5}$. If the engine coolant temperature $T_W$ assumes a value other than the five predetermined coolant temperature values, the $K_{TW}$ value is determined by means of an interpolation method.

Then, the program proceeds to a step 308 wherein a first predetermined value $K_{ASTR1}$ defining the declining slope of the $K_{AST}$ value. This first predetermined value $K_{ASTR1}$ and a second predetermined value $K_{ASTR2}$ are set such that until the $K_{AST}$ value declines to the first predetermined value $K_{ASTR1}$, the $K_{AST}$ value is decreased at a relatively large rate, and after the $K_{AST}$ is decreased below the first predetermined value $K_{ASTR1}$, the $K_{AST}$ value is decreased at a relatively small rate, thereby better adapting the fuel increasing coefficient $K_{AST}$ to a fuel incremental value required by the engine immediately after starting thereof.

The first predetermined value $K_{ASTR1}$ is calculated by the following equation (3):

$$K_{ASTR1}=(K_{AST0}-1)\times R_{AST}+1 \quad (3)$$

where $K_{AST0}$ is the initial value of the fuel increasing coefficient $K_{AST}$ calculated at the step 307, and $R_{AST}$ is a coefficient (e.g. 0.5) which is set to such a value that the fuel quantity supplied to the engine during the after-start fuel increasing period becomes appropriate to the engine temperature.

It is then determined at a step 309 whether or not the initial value $K_{AST0}$ of the fuel increasing coefficient $K_{AST}$ set at the step 309 is smaller than a predetermined lower limit $K_{ASTLMT}$ (e.g. 1.05). If the answer to the question of the step 309 is affirmative or Yes, that is, $K_{AST}<K_{ASTLMT}$, the coefficient $K_{AST}$ is set to the predetermined lower limit $K_{ASTLMT}$, at a step 310, while if the answer is negative or No, the coefficient $K_{AST}$ determined at the step 307 is directly applied at a step 321.

The above described steps 302–310 for determining the initial value $K_{ASTO}$ of the fuel increasing coefficient $K_{AST}$ and the first predetermined value $K_{ASTR1}$ are executed only one time immediately after completion of the cranking operation of the engine, followed by termination of the program.

If the answer to the question of the step 301 is negative or No, that is, if it is determined that the engine was not being cranked in the last loop, the program proceeds to a step 311, where it is determined whether the fuel increasing coefficient $K_{AST}$ obtained in the last loop is larger than the second predetermined value $K_{ASTR0}$ (e.g. 1.20). If the answer is negative or No, a decreasing constant $\Delta K_{AST}$ is set to a first predetermined value $DK_{AST1}$ at a step 313, followed by the program proceeding to a step 315, while if the answer to the question of the step 311, the program proceeds to a step 312.

In the step 312, a determination is made as to whether or not the KAST value is larger than the first predetermined value $K_{ASTR1}$ obtained in the step 308. If the answer is negative or No, the aforesaid step 313 is executed, while if the answer is affirmative or Yes, the decreasing constant $\Delta K_{AST}$ is set to a second predetermined value $DK_{AST0}$ which is larger than the first predetermined value $DK_{AST1}$, at a step 314.

The program then proceeds to the step 315 wherein 1 is added to the aforesaid control variable nT, and then at a step 316 it is determined whether or not the control variable nT set at the step 315 is equal to the predetermined number C set at the step 304 or the step 305. If the answer to the question of the step 316 is negative or No, that is, if the control variable nT does not yet reach the predetermined number C, the program is immediately terminated. If the answer to the question of the step 316 is affirmative or Yes, that is, if the control variable nT has reached the predetermined number C, the program proceeds to a step 317. In the step 317, the $K_{AST}$ value to be applied in the present loop is set by deducting the decreasing constant $\Delta K_{AST}$ set at the step 313 or at the step 314 from the $K_{AST}$ value obtained in the last loop. Then, the program proceeds to a step 318 wherein the control variable nT is reset to 0. The, at a step 319, a determination is made as to whether or not the KAST value set at the step 317 is larger than 1.0, and if the former is larger than 1.0, the program is immediately terminated.

Figure 6:
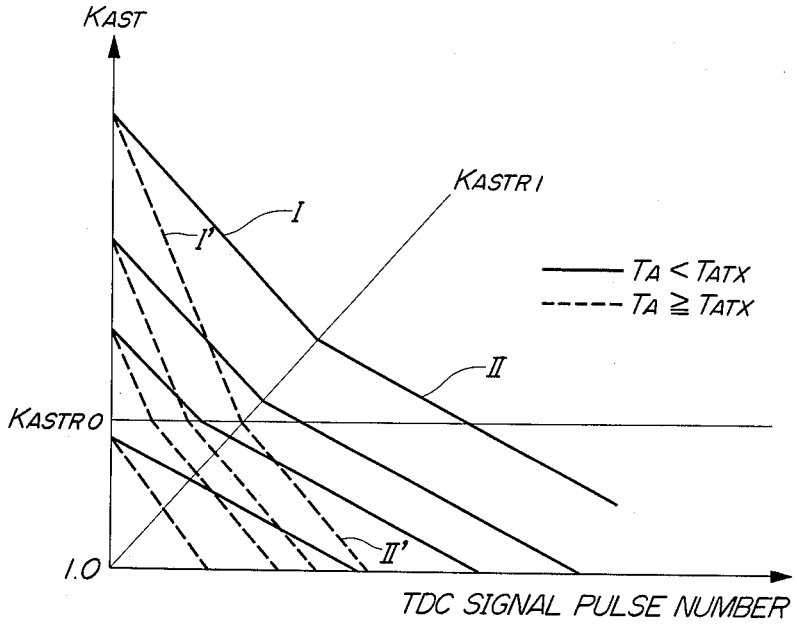
FIG. 6 is a graph showing how the value of the after-start fuel increasing coefficient $K_{AST}$, which is calculated in the manner shown in FIG. 3, changes as pulses of a TDC signal are generated.

Thereafter, the present program is repeatedly executed each time a pulse of the TDC signal is generated, so that the fuel increasing coefficient $K_{AST}$ declines along one of the solid bent lines or the broken bent lines in FIG. 6, which lines are selected depending upon the sensed intake air temperature and engine coolant temperature read immediately before completion of the cranking operation of the engine.

More specifically, if the intake air temperature $T_A$ is lower than the predetermined value $T_{ATX}$, that is, if it is supposed that no gas bubbles are present in the fuel, the predetermined number C is set to the larger predetermined value $n_{COLD}$ at the step 305 in FIG. 3. If this predetermined value is set at 6 for instance, the decrease of the fuel increasing coefficient $K_{AST}$ at the step 317 in FIG. 3 is executed each time the control variable nT reaches the predetermined number C ($=n_{COLD}$), that is, each time six TDC signal pulses are generated, so that the fuel increasing coefficient $K_{AST}$ declines along one of the solid bent lines I, II in FIG. 6, thereby carrying out desired fuel quantity increasing after the start of the engine.

On the other hand, if the intake air temperature $T_A$ is higher than the predetermined value $T_{ATX}$, that is, if it is supposed that gas bubbles are contained in the fuel, the step 304 in FIG. 3 is executed to set the predetermined number C to the smaller predetermined value $n_{HOT}$. If this predetermined value $n_{HOT}$ is set at 2, for instance, the decrease of the fuel increasing coefficient $K_{AST}$ is executed each time the control variable nT reaches the predetermined number ($=n_{HOT}$) in the step 316, that is, each time two TDC signal pulses are generated. Thus, the decreasing rate of the $K_{AST}$ value is larger than that obtained when $T_A < T_{ATX}$ stands (in the present example, $n_{COLD}/n_{HOT}=3$ (times), so that the $K_{AST}$ value declines along one of the broken bent lines I', II' in FIG. 6, thereby carrying out desired fuel quantity increasing after the start of the engine.

According to the manner described above, when the engine is in such a cold state that no gas bubbles are contained in the fuel within the engine intake system such as the fuel injection valves 6, the fuel quantity decreasing rate is set to a relatively small value so as to prolong the after-start fuel increasing period whereby the fuel quantity is increased to an extent sufficient to overcome load on the engine during warming-up thereof, whereas when the engine is in such a hot state that gas bubbles are contained in the fuel within the engine intake system, the fuel quantity increasing rate is set to a relatively large value so as to shorten the after-start fuel increasing period whereby the fuel quantity is increased only during a period of time required for removing the gas bubbles from the fuel and hence over-riching of the mixture supplied to the engine can be prevented. In this way, according to the method of the invention, improved driveability of the engine after starting can always be ensured irrespective of the engine temperature assumed at the start of the engine, and wasteful consumption of the fuel can be prevented.

When the fuel increasing coefficient $K_{AST}$ has been decreased to 1.0 after repeated execution of the program, the answer to the question of the step 319 becomes negative or No. Then it is estimated that the after-start fuel increasing period has been terminated and hence the fuel increasing coefficient $K_{AST}$ is set to 1.0 at a step 320, followed by termination of the program.

Figure 7:
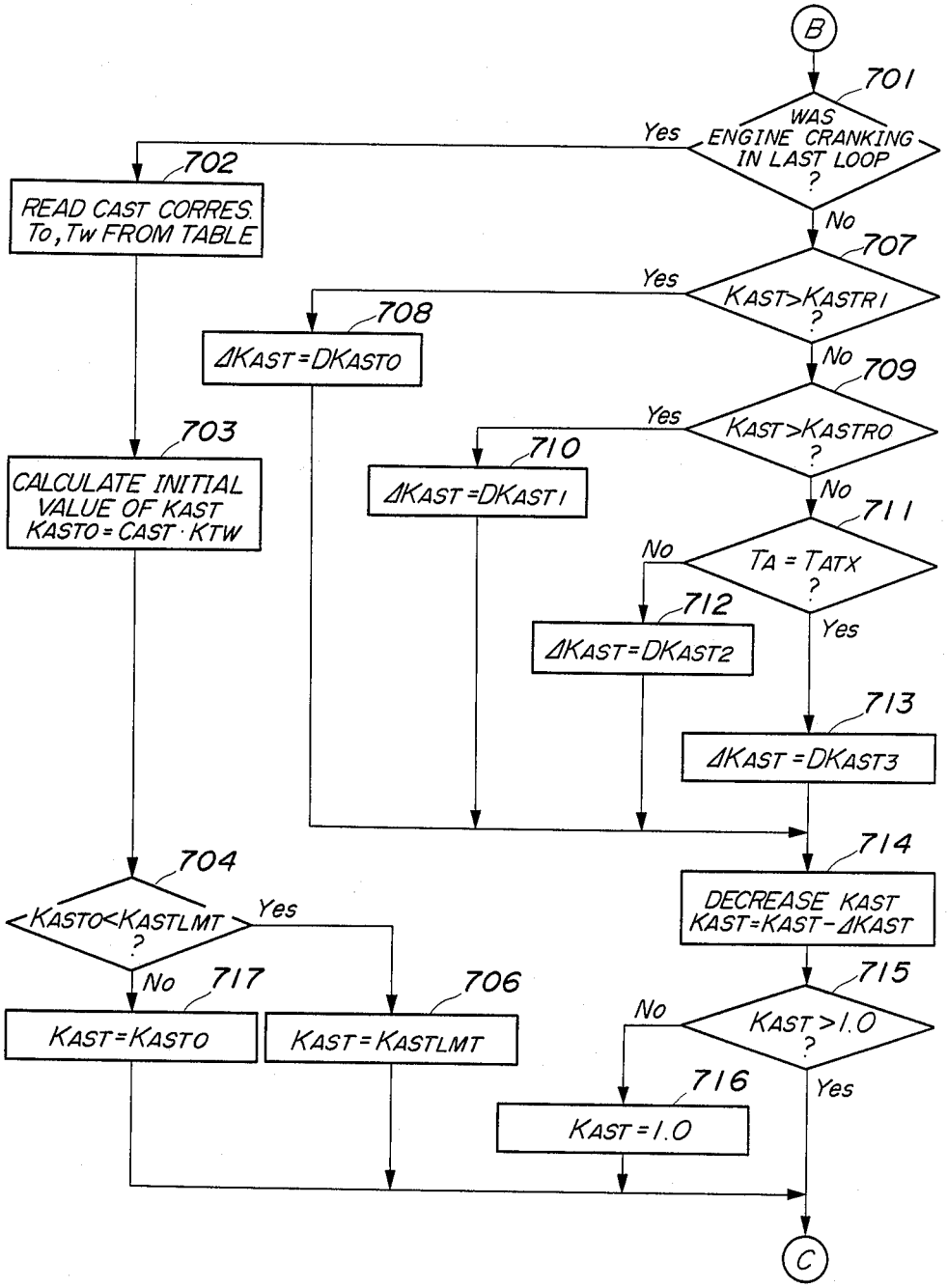
FIG. 7 is a flowchart similar to FIG. 3, showing a second embodiment of the invention.

FIG. 7 shows a subroutine for calculating the fuel increasing coefficient $K_{AST}$ according to a second embodiment of the invention. The second embodiment is distinguished from the first embodiment described above only in the subroutine of FIG. 7, but the other parts of the method are identical with those of the first embodiment.

In a step 701, it is determined whether or not the engine was being cranked in the last loop. This determination is made in the same manner as in the first embodiment (the step 301 in FIG. 3). If the answer is affirmative or Yes, that is, if the present loop is the first step executed in synchronism with a first pulse of the TDC signal generated immediately after completion of the cranking operation of the engine, the program proceeds to a step 702.

In the step 702, a value of the coefficient $C_{AST}$ is read from a table stored in the memory means 5c, which corresponds to the sensed engine coolant temperature $T_W$, in the same manner as in the first embodiment (the step 306 in FIG. 3). Then, the initial value $K_{AST0}$ of the fuel increasing coefficient $K_{AST}$ is calculated at a step 703 by the use of the aforementioned equation (2) by substituting the read $C_{AST}$ value thereinto, in the same manner as in the first embodiment (the step 307 in FIG. 3).

Then, a determination is made as to whether or not the initial value $K_{AST0}$ thus calculated is smaller than a predetermined lower limit $K_{ASTLMT}$ (e.g. 1.2), at a step 704. If the answer is negative or No, the initial value $K_{AST0}$ determined in the step 703 is directly applied as the coefficient $K_{AST}$ at a step 717, whereas if the answer is affirmative or Yes, the program proceeds to a step 706 wherein the coefficient $K_{AST}$ is set to the predetermined lower limit $K_{ASTLMT}$ instead of using the initial value $K_{AST0}$ determined at the step 703, followed by termination of the program.

The steps 702–706 for setting the initial value $K_{AST0}$ of the fuel increasing coefficient $K_{AST}$ described above are executed only one time immediately after completion of the cranking operation of the engine.

If the answer to the question of the step 701 is negative or No, that is, if the engine was not being cranked in the last loop, the program proceeds to a step 707 wherein it is determined whether or not the fuel increasing coefficient $K_{AST}$ is larger than a first predetermined value $K_{ASTR1}$ (e.g. 1.60). If the answer to this question is affirmative or Yes, that is, if $K_{AST} > K_{ASTR1}$ stands, the decreasing coefficient $\Delta K_{AST}$ is set to a first predetermined value $D_{KAST0}$ at a step 708, followed by the program proceeding to a steo 714. If the answer to the question of the step 707 is negative or No, that is, if $K_{AST} \leqq K_{ASTR1}$ stands, the program proceeds to a step 709 wherein it is determined whether or not the fuel increasing coefficient $K_{AST}$ is larger than a second predetermined value $K_{ASTR0}$ (e.g. 1.35) which is smaller than the second predetermined value $K_{ASTR1}$. If the answer is affirmative or Yes, that is, if $K_{AST} > K_{ASTR0}$ stands, the decreasing constant $\Delta K_{AST}$ is set to a second predetermined value $DK_{AST1}$ which is smaller than the first predetermined value $DK_{AST0}$, at a step 710, followed by the program proceeding to the step 714.

If the answer to the question of the step 709 is negative or No, that is, if $K_{AST} \leqq K_{ASTR0}$ stands, the program proceeds to a step 711 wherein it is determined whether or not the sensed intake air temperature $T_A$ is smaller than a predetermined value $T_{ATX}$ (e.g. 70° C.). If the answer is negative or No, that is, if $T_A \leqq T_{ATX}$ stands, the decreasing constant $\Delta K_{AST}$ is set to a third predetermined value $DK_{AST2}$ which is smaller than the second predetermined value $DK_{AST1}$ at a step 712, while if the answer is affirmative or Yes, that is, if $T_A > T_{ATX}$ stands, the decreasing constant $\Delta K_{AST}$ is set to a fourth predetermined value $DK_{AST3}$ which is larger than the third predetermined value $DK_{AST2}$ at a step 713. This is followed by execution of the step 714.

In the step 714, the decreasing constant $\Delta K_{AST}$ set in any one of the steps 708, 710, 712 and 713 is deducted from a value of the fuel increasing coefficient $K_{AST}$ applied in the last loop to obtain the $K_{AST}$ value to be applied in the present loop.

After setting of the $K_{AST}$ value, the program proceeds to a step 715 wherein it is determined whether or not the KAST value thus set is larger than 1.0. If the $K_{AST}$ value is larger than 1.0, the program is immediately terminated.

Figure 8:
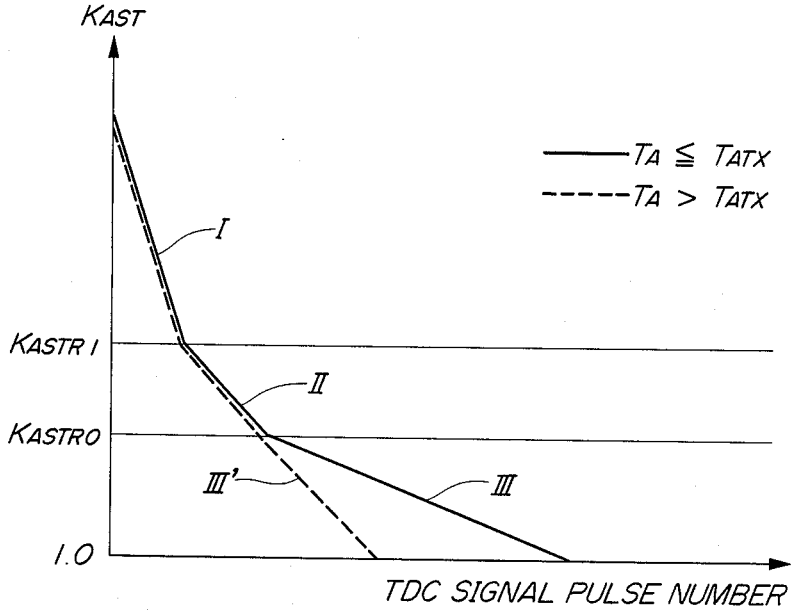
FIG. 8 is a graph similar to FIG. 6, according to the second embodiment of the invention.

As the deduction at the step 714 is repeatedly carried out as TDC signal pulses are generated, the fuel increasing coefficient $K_{AST}$ declines along a curve formed by the solid lines I, II and III or a curve formed by the solid lines I and II and the broken line III' shown in FIG. 8, for instance. To be specific, after the initial value $K_{AST0}$ of the fuel increasing coefficient $K_{AST}$ has been set in response to the engine coolant temperature $T_W$ immediately before completion of the cranking operation, when the coefficient $K_{AST}$ is larger than the first predetermined value $K_{ASTR1}$, it is decreased at a higher rate as shown by the line I in FIG. 8; when the coefficient $K_{AST}$ lies between the first and second predetermined values $K_{ASTR1}$ and $K_{ASTR0}$, it is decreased at a smaller rate as shown by the line II in FIG. 8; and when the coefficient $K_{AST}$ is smaller than the second predetermined value $K_{ASTR0}$, it is decreased at a further smaller rate when the sensed intake air temperature $T_A$ is lower than the predetermined value $T_{ATX}$, as shown by the solid line III in FIG. 6, whereas it is decreased at a rate larger than the solid line III, when the sensed intake air temperature $T_A$ is higher than the predetermined value $T_{ATX}$, that is, when the temperature of fuel in the engine intake system is very high, as shown by the broken line III' in FIG. 8.

In this way, in the second embodiment described above, since the decreasing rate of the fuel increasing coefficient which is smaller than the predetermined value $K_{ASTR0}$ is set in dependence on the intake air temperature $T_A$ such that the after-start fuel increasing period is made longer when the engine is in such a cold state that no gas bubble is contained in the fuel within the engine intake system, e.g. the fuel injection valves 6, whereas the same period is made shorter when the engine is in such a hot state that gas bubbles are contained in the fuel, thereby always ensuring good driveability of the engine immediately after the start of the engine irrespective of the engine temperature assumed at the start of the engine, like the first embodiment.

When the fuel increasing coefficient $K_{AST}$ has been decreased to 1.0 or below after repeated deduction of the $K_{AST}$ value at the step 714, the answer to the question of the step 715 becomes negative or No. Then it is judged that the after-start fuel increasing period is over, and then the fuel increasing coefficient $K_{AST}$ is set to 1.0 at a step 716, followed by termination of the program.

What is claimed is:

1. A method of controlling the supply of fuel to an internal combustion engine having an intake system after starting, wherein an initial value of a fuel increment is set to a value dependent upon a temperature of the engine after starting thereof, the fuel increment is progressively decreased from the set initial value thereof at a predetermined rate, and a fuel quantity corrected by the progressively decreased fuel increment is supplied to the engine, the method comprising the steps of:

(a) sensing a temperature of the intake system of the engine; and (b) setting the predetermined rate at which the fuel increment is progressively decreased to a larger value as the sensed temperature of said intake system is higher.

2. A method as claimed in claim 1, wherein the temperature of the engine is sensed immediately after the starting of the engine.

3. A method as claimed in claim 1, wherein when the sensed temperature of the intake system is higher than a predetermined value corresponding to the boiling point of fuel, the predetermined rate of decrease of the fuel increment is set to a larger value than that to which it is set when the sensed temperature is lower than the predetermined value.

4. A method as claimed in claim 3, wherein the initial value of the fuel increment is set at the time of generation of a pulse of a predetermined control signal, pulses of which are representative of respective predetermined crank angles of the engine, immediately after completion of cranking of the engine, the set initial value of the fuel increment being subsequently decreased by a predetermined amount each time a first predetermined number of pulses of the control signal are generated when the sensed temperature of the intake system is lower than the predetermined value corresponding to the boiling point of fuel, and the set initial value of the fuel increment being subsequently decreased by the predetermined amount each time a second predetermined number of pulses of the control signal are generated when the sensed temperature of the intake system is higher than the predetermined value, the second predetermined number being smaller than the first predetermined number.

5. A method as claimed in claim 4, wherein when the fuel increment is larger than a predetermined value, the predetermined amount is set to a first value, and when the fuel increament is smaller than the predetermined value, the predetermined amount is set to a second value smaller than the first value.

6. A method as claimed in claim 5, wherein the predetermined value of the fuel increment is set to a value dependent upon the set initial value of the fuel increment.

7. A method as claimed in claim 3, wherein the initial value of the fuel increment is set at the time of generation of a pulse of a predetermined control signal, pulses of which are representative of respective predetermined crank angles of the engine, immediately after completion of cranking of the engine, the set initial value of the fuel increment being subsequently decreased by a first predetermined amount each time a pulse of the control signal is generated when the sensed temperature of the intake system is lower than a predetermined value corresponding to the boiling point of fuel, and the set initial value of the fuel increment being subsequently decreased by a second predetermined amount each time a pulse of the control signal is generated when the sensed temperature of the intake system is higher than the predetermined value, the second predetermined amount being larger than the first predetermined amount.

8. A method as claimed in claim 7, wherein the decrease of the fuel increment by the first predetermined amount or by the second predetermined amount is effected when the fuel increment is smaller than a predetermined value.

* * * * *